United States Patent [19]

Win

[11] Patent Number: 4,907,515

[45] **Date of Patent: * Mar. 13, 1990**

[54] SHIPPING PALLET AND THE LIKE AND METHOD OF FORMING SAME

[75] Inventor: Michael M. Win, Fairport, N.Y.

[73] Assignee: Mobil Oil Corporation, New York, N.Y.

[ * ] Notice: The portion of the term of this patent subsequent to Apr. 9, 2002 has been disclaimed.

[21] Appl. No.: 661,984

[22] Filed: Oct. 17, 1984

[51] Int. Cl.[4] ..... B65D 19/00

[52] U.S. Cl. ..... 108/51.1; 206/497

[58] Field of Search ..... 108/51.1, 52.1, 56.1, 108/56.3, 901; 248/346, 678; 428/910; 206/497

[56] References Cited

U.S. PATENT DOCUMENTS

| | | | |
|---|---|---|---|
| T886,012 | 5/1971 | Small | 108/51.1 |
| 3,788,462 | 1/1974 | Meincer | 206/497 |
| 3,809,311 | 5/1974 | Fohrman et al. | 206/497 |
| 3,853,218 | 12/1974 | Grasvoll | 206/497 |
| 3,884,935 | 5/1975 | Burns III | 206/497 |
| 3,940,101 | 2/1976 | Heidelbach | 108/56.3 |
| 3,986,611 | 10/1976 | Dreher | 208/597 |
| 4,254,869 | 3/1981 | Heier | 428/910 |
| 4,509,432 | 4/1985 | Win | 108/51.1 |

FOREIGN PATENT DOCUMENTS

| | | | |
|---|---|---|---|
| 2064373 | 11/1967 | Austria | 108/51.5 |
| 2549252 | 5/1977 | Fed. Rep. of Germany | 108/56.3 |
| 1015218 | 10/1952 | France | 108/51.1 |
| 1443824 | 7/1976 | United Kingdom | 206/497 |

*Primary Examiner*—Peter A. Aschenbrenner
*Attorney, Agent, or Firm*—Alexander J. McKillop; Charles J. Speciale; James P. O'Sullivan Sr.

[57] ABSTRACT

A shipping pallet comprising a load deck of plastic shrink wrap film, wrapped about a pallet frame, said film being in its heat shrunk condition. The method of preparing the same comprising, after wrapping the plastic film with heat shrinkable oriented thermoplastic film, subjecting the arrangement to a temperature sufficient to heat shrink the film to a taut product supporting condition.

2 Claims, 2 Drawing Sheets

SHIPPING PALLET AND THE LIKE AND METHOD OF FORMING SAME

BACKGROUND OF THE INVENTION

This invention relates to shipping pallets, such as lift truck pallets and similar pallets adapted to be lifted and transported by means of a fork lift of some type. Copending U.S. patent applications Ser. No. 484,797, filed Apr. 14, 1983 and U.S. Ser. No. 636,473, filed July 31, 1984, are directed to shipping pallets having plastic stretch wrap film as the product support surfaces.

Conventional wooden pallets comprise a lumber deck nailed to, usually 2×4, stringers. Such pallets are expensive, heavy in weight and quite fragile.

It is an object of the present invention to provide an inexpensive, easily constructed, light-weight, reusable, reconstructable, shipping pallet.

It also is an object of the present invention to provide a process for forming such a pallet.

SUMMARY OF THE INVENTION

The present invention relates to a shipping pallet comprising a load deck of shrink wrap film, wrapped with heat-shrunk tension about a pallet frame. The pallet may include spacer means accommodating the lifting of the pallet.

The present invention also relates to a process for forming the above-described pallet which process generally comprises assembling a support frame, covering the support frame with one or more sheets of a thermoplastic shrink wrap film and, thereafter, subjecting the structure to heat sufficient to shrink said film to yield a taut product-supporting heat-shrunk plastic film surface as part of said pallet. The method may also provide for the inclusion of spacer means to accommodate the lifting of said pallet.

BRIEF DESCRIPTION OF THE DRAWINGS

The manner of accomplishing the foregoing and other objects of this invention will be apparent from the accompanying specification and claims together with the drawings, wherein:

DETAILED DESCRIPTION OF THE INVENTION

Figure 1:
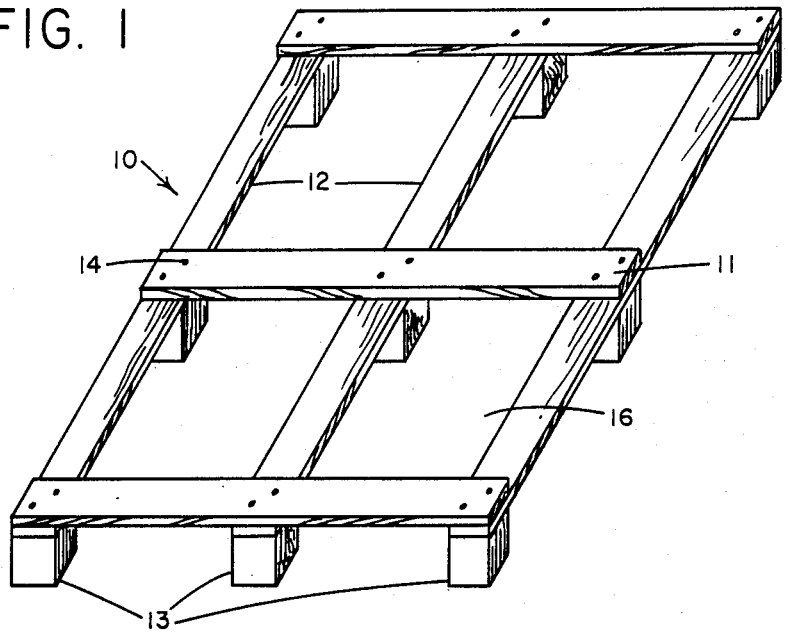
FIG. 1 is a perspective view of a pallet frame.

In the form of the invention illustrated by way of example in FIGS. 1–4, the pallet of the invention includes, with reference to FIG. 1, a representative entire pallet frame 10 composed of stringers 11, runners 12, spacer blocks 13 and rectangular openings 16. The stringers, runners, and spacer blocks can be of any material, for example, metal, wood, plastic or any combination thereof. The cross-sectional shape of each member likewise is not material and can be square, rectangular, tubular, etc. The spacer blocks or means can be an integral part of the runners, e.g., a 2×4 sawed so as to have two or more spacer legs to accommodate the tines of a fork apparatus or of a lift truck. The stringer, runners and spacer blocks can be fastened together by a fastening means 14. This fastening means can be of any type, for example, nails or bolts or screws or clamps, etc. In addition it is possible that the frame members of the pallet car be designed to interlock so as to be maintained in contact without the use of any separate means except the shrink wrap film. In this case the shrink wrap film can be stretched over the contacting members of the pallet frame and, after securing or anchoring the heat-shrink film, subjecting the arrangement to sufficient heat to shrink the film. The tension force of the heat-shrunk film will adequately keep the pallet secure and intact.

Figure 2:
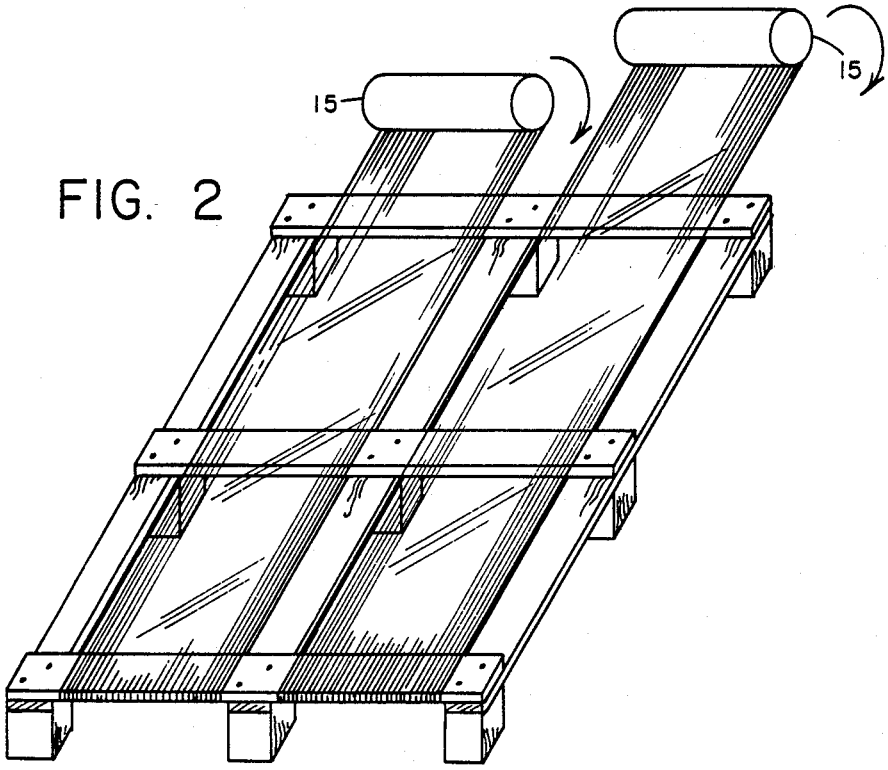
FIG. 2 is a perspective view depicting a manner of applying shrink wrap plastic surfaces over the rectangular openings of a pallet frame as depicted in FIG. 1.
Figure 3:
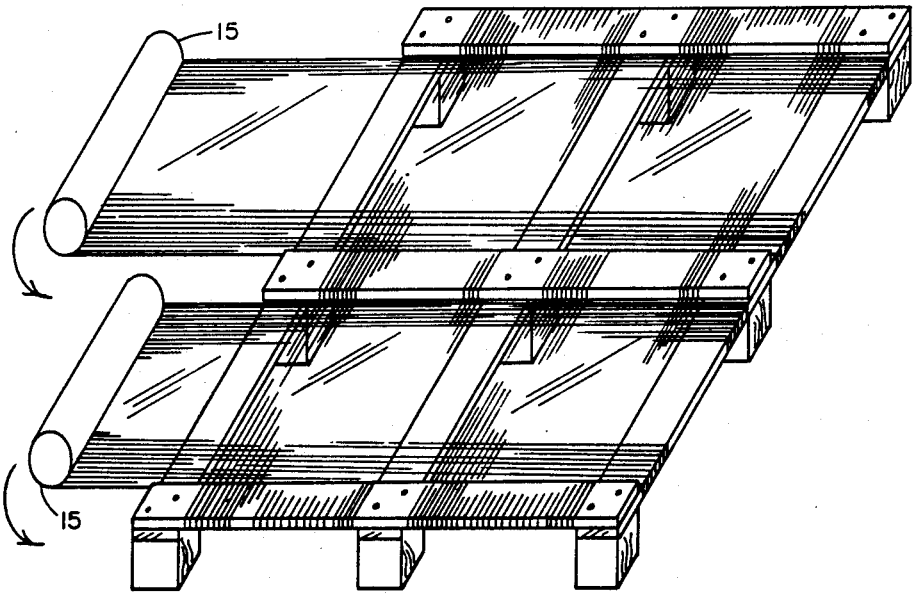
FIG. 3 is a perspective view depicting a manner of cross-covering the shrink wrap plastic surfaces of the structure of FIG. 3.
Figure 4:
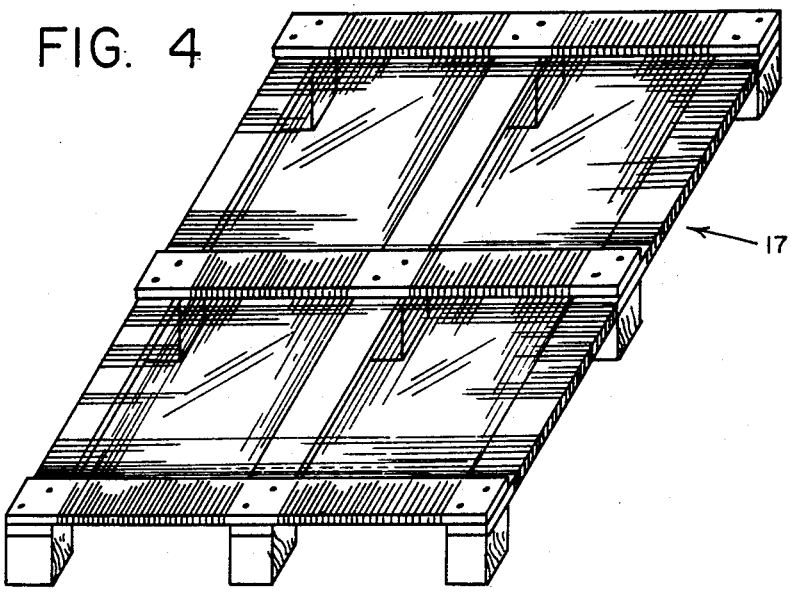
FIG. 4 depicts a completed pallet having a plurality of taut, heat-shrunk plastic film support surfaces.

FIG. 2 shows shrink wrap plastic film 15 being wrapped securely about open rectangular areas 16. FIG. 3 shows shrink wrap plastic film 15 being cross-wrapped over the film of FIG. 2 to yield, after heat shrinking, the completed pallet 17. Such a pallet has a plurality of heat-shrunk plastic film support surfaces at right angles to one another. By the above-described structure an inexpensive, easily constructed, shipping pallet having novel heat-shrunk plastic support surfaces is provided. While the pallet frame can be constructed of any material, an inexpensive hardwood frame is preferred. Another preferred frame is one made of either solid or foamed plastic or a lightweight metal material. The support surface can be provided with any heat-shrink polymer film but particularly preferred is a polyolefin heat-shrink film. A representative class of heat-shrink films are the type disclosed in U.S. Pat. No. 3,634,553, the disclosure of which is incorporated herein by reference.

One typical heat shrinkable oriented thermoplastic film comprises:

(a) from about 10–90% by weight, e.g. 35.0%, of a high isotatic content polypropylene resin having a melt index at 230° C. of about 0.1 to about 5.0, e.g. 0.2–0.3; and (b) from about 10–90% by weight e.g. 65% of a high isotatic content ethylene/butene-1 copolymer resin containing from about 1% to less than 10% by weight, e.g., 3–6%, ethylene. It is preferred that the defined film be biaxially oriented. This oriented film is further characterized by having a film area reduction ratio of at least about 2:1 and film shrink energies of at least about 300 p.s.i. when exposed to a temperature of about 212° F. or higher.

The above-described shrink film blend compositions described are oriented at a temperature above the melting point of the low melt copolymer and below the melt temperature of the higher melting homopolymer.

The heat shrink film contemplated by the present invention should have a relatively high ratio of film area reduction after exposure to heat in order to ensure a taut tight film surface that will virtually have the same ability to support product, including concrete blocks, placed upon the film support surface of the subject pallets, as a rigid support surface. Oriented films are obtained by stretching processes in which tensions capable of stretching the film are applied to the film, the directions of which form an angle of about 90° utilizing well known prior techniques. These film stretching tensions may be applied sequentially, as in the case where the film, after forming, is subjected to stretching in the longitudinal direction and thereafter tension is applied in a transverse direction to stretch the film transversely. Alternatively, the stretching may simultaneously occur in both directions. Such processes are well known in the art and include, for example, the "double bubble" method which comprises extrusion of a tubular base film, cooling of the tubular film, reheating and inflation of the tube and simultaneously drawing the inflated tube in a longitudinal direction thereby imparting biaxial orientation to the film. A further contemplated method for the biaxial orientation of the film comprises passing the film sheet through a series of rotating draw rollers, which impart longitudinal direction stretching to the film and, subsequently, transversely drawing the longitudinally stretched film, for example, by passing it through a tenter frame wherein the film is stretched in a transverse direction. The film thickness of the heat shrink-film prior to being heat-shrunk can range from less than about 0.1 mils to 4 mils and above.

When the film layers become worn or torn through use, they can be removed and the pallet frame re-covered with new shrink wrap film at little expense. The used film can, of course, be recycled and formed into new shrink film.

The term rectangle as used herein is generic to a square. The shrink wrap film preferred is a product commercially available from the Mobil Corporation, Macedon, New York. It can be applied to the constructed frame in any manner which will permit secure tensioning of the film after the application of appropriate heat. For example, with five 0.5 mil heat-shrink film layers, of the type described above, wrapped in one direction about a rectangular fork-liftable frame and five 0.5 mil heat-shrink layers wrapped 90 degrees thereto, and the combination thereafter heat-shrunk to tension the film, an excellent shipping pallet is formed. Heat shrinking can be accomplished by passing the wrapped frame through a heat tunnel maintained at about 212° F. Such a pallet can easily and indefinitely carry extremely dense loads, for example, a ton of standard cinderblocks.

What is claimed is:

1. A process for preparing a shipping pallet comprising:

(a) arranging a plurality of elongated narrow stringers in parallel, spaced relation;

(b) arranging a plurality of elongated narrow runners in parallel, spaced relation substantially at right angles to said stringers so as to form the perimeter of a plurality of comparatively broad rectangles;

(c) providing spacer means defining fork lift openings in the sides of the pallet;

(d) overwrapping said plurality of comparatively broad open spaces framed by said stringers and runners with a plurality of layers of heat shrink wrap film; and (e) subjecting said film to sufficient heat to shrink the same to a taut, product supporting condition.

2. The process of claim 1 wherein said overwrapping includes some cross overwrapping.

* * * * *